United States Patent [19]

Gaunt

[11] Patent Number: 5,044,274

[45] Date of Patent: Sep. 3, 1991

[54] INK CONDITIONING DEVICE FOR REMOVING EXCESS WATER FROM EMULSIONS OF INK AND WATER DURING LITHOGRAPHIC PRINTING

[75] Inventor: David K. Gaunt, Horsforth, United Kingdom

[73] Assignee: Vickers plc, London, United Kingdom

[21] Appl. No.: 425,632

[22] Filed: Oct. 23, 1989

[30] Foreign Application Priority Data

Oct. 31, 1988 [GB] United Kingdom ..... 8825411

[51] Int. Cl.[5] ..... B41F 7/20

[52] U.S. Cl. ..... 101/142; 101/148; 101/350; 101/451; 210/542

[58] Field of Search ..... 101/148, 147, 451, 452, 101/350; 210/167, 691, 542

[56] References Cited

U.S. PATENT DOCUMENTS

| | | | |
|---|---|---|---|
| 2,395,151 | 2/1946 | Sodomka | 101/451 X |
| 2,604,848 | 7/1952 | Mullen | 101/147 |
| 2,733,653 | 2/1956 | Mullen | 101/147 |
| 4,211,167 | 7/1980 | Corse | 101/148 |
| 4,527,479 | 7/1985 | Dahlgren et al. | 101/148 X |
| 4,787,314 | 11/1988 | Harada et al. | 101/148 X |
| 4,864,925 | 9/1989 | Van Kanegan et al. | 101/148 X |

FOREIGN PATENT DOCUMENTS

| | | | |
|---|---|---|---|
| 0286305 | 10/1988 | European Pat. Off. . | |
| 2397939 | 2/1979 | France . | |
| 163857 | 7/1986 | Japan | 101/148 |
| 74655 | 4/1987 | Japan | 101/148 |

OTHER PUBLICATIONS

Patent Abstracts of Japan, Publication No. 59106969. Vol. 10, No. 155 (M-485) [221], Jun. 4, 1986. Vol. 11, No. 258 (M-618) [2705], Aug. 21, 1987.

*Primary Examiner*—Clifford D. Crowder
*Attorney, Agent, or Firm*—Armstrong, Nikaido, Marmelstein, Kubovcik & Murray

[57] ABSTRACT

A device for removing excess water from an aqueous emulsion of lithographic printing ink comprises a pair of rollers co-operating together to form a nip. Emulsified ink is fed to the nip and is broken down into an ink phase and an aqueous phase by the pressure exerted by the nip. The aqueous phase is displaced away from the ink phase by gas jets. The ink phase remains on the surface of one of the rollers and is removed and returned to the printing press.

6 Claims, 3 Drawing Sheets

Figure 1:
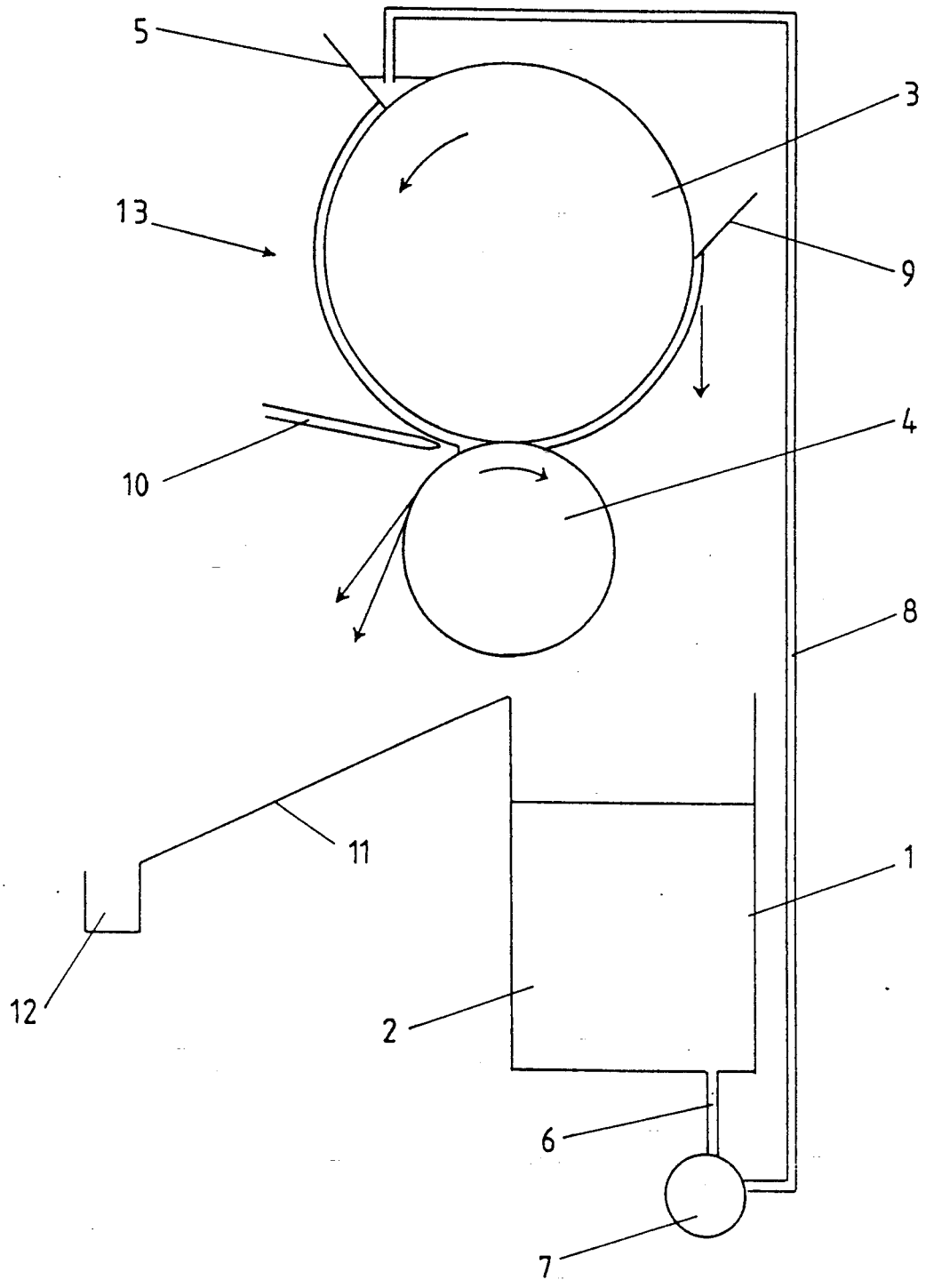

INK CONDITIONING DEVICE FOR REMOVING EXCESS WATER FROM EMULSIONS OF INK AND WATER DURING LITHOGRAPHIC PRINTING

This invention relates to lithographic printing and is concerned with a device for reconditioning lithographic printing ink after printing.

In lithographic printing, a printing plate is used which includes a printing image area which is substantially co-planar with the non-printing area and the lithographic printing process relies upon the differing affinities of these areas for oil-based ink and water. The printing image area is water-repellent and ink receptive and the non-printing area is water-receptive and ink repellent. The lithographic printing plate is mounted on a plate cylinder and, during printing, an aqueous fountain solution is applied to the plate usually by means of a roller system or by a series of spray nozzles. The fountain solution wets the non-printing area and is repelled by the printing image. Lithographic printing ink is then applied to the plate. Lithographic printing ink is a greasy oil-based ink and it is repelled by the wet non-printing area and received by the printing image. The ink on the image is then transferred to the paper or like material to be printed.

Inking systems for lithographic printing are known in which ink in excess of that received by the printing image is re-cycled for re-use. Anilox inking systems are of this type and such a system is described in our European patent specification No. 0 286 305 wherein the ink is fed to the lithographic printing plate by means of an engraved roller to which ink is applied by means of an inking device comprising (i) a substantially closed ink duct bounded by the cylindrical surface of the engraved roller, (ii) a means of supplying ink from an ink tank to the duct, and (iii) a means of returning ink from the duct to the tank. Thus, the inking system is in the form of a closed loop. Although Anilox inking systems of this type have many technical advantages, the excess ink removed from the printing plate is in the form of an emulsion with the aqueous fountain solution and thus it is emulsified ink which is returned through the closed loop back to the tank. Unless corrective action is taken, the water content of the ink within the system will progressively increase and may reach an unacceptable level at which print quality is adversely affected.

It is an object of the present invention to provide an ink conditioning device which will continuously remove excess water from an aqueous emulsion of ink during lithographic printing so as to enable continuous printing to be carried out using ink having a stable degree of emulsification.

According to one aspect of the present invention there is provided an ink conditioning device for removing excess water from an aqueous emulsion of ink during lithographic printing, which device comprises:

(i) a pair of rotatable rollers co-operating together to form a nip,
(ii) a means of forming a film of the emulsion on the surface of one of the rollers, which film is subjected to pressure at the nip to break down the emulsion into an ink phase and an aqueous phase,
(iii) jetting means to blow gas at the nip so as to displace the aqueous phase away from the nip, and onto a collector for the aqueous phase, and
(iv) to remove the ink phase from said one of the rollers after it has passed through the nip.

The ink conditioning device may be in the form of a separate unit for use in conjunction with the ink tank of a printing press. Alternatively, the device may be included as an integral part of the tank.

According to another aspect of the present invention there is provided a lithographic printing press comprising:

(i) a plate cylinder for carrying a lithographic printing plate,
(ii) a means of applying aqueous fountain solution the lithographic printing plate,
(iii) an inking device for applying ink to the lithographic printing plate,
(iv) a tank for ink,
(v) a means of supplying ink from said tank to the inking device,
(vi) a means of returning ink, emulsified with fountain solution, from said device to said tank, and
(vii) an ink conditioning device to remove excess water from the emulsified ink which device comprises:
(viii) a pair of rotatable rollers cooperating together to form a nip,
(ix) a means of feeding a film of the emulsified ink to the nip to subject the film to pressure and thereby break down the emulsified ink into an ink phase and an aqueous phase,
(x) means of separating the aqueous phase from the ink phase at the nip, and
(xi) means for returning the ink phase to the tank.

Advantageously, an instrument may be provided which is capable of measuring the water content of the emulsified ink. The ink conditioning device may then be switched on and off in accordance with the water content as determined by the instrument. In this way, and by adding fresh non-emulsified ink to the tank as necessary, an automatic system for providing ink of constant water content to the printing plate can be provided.

Figure 2:
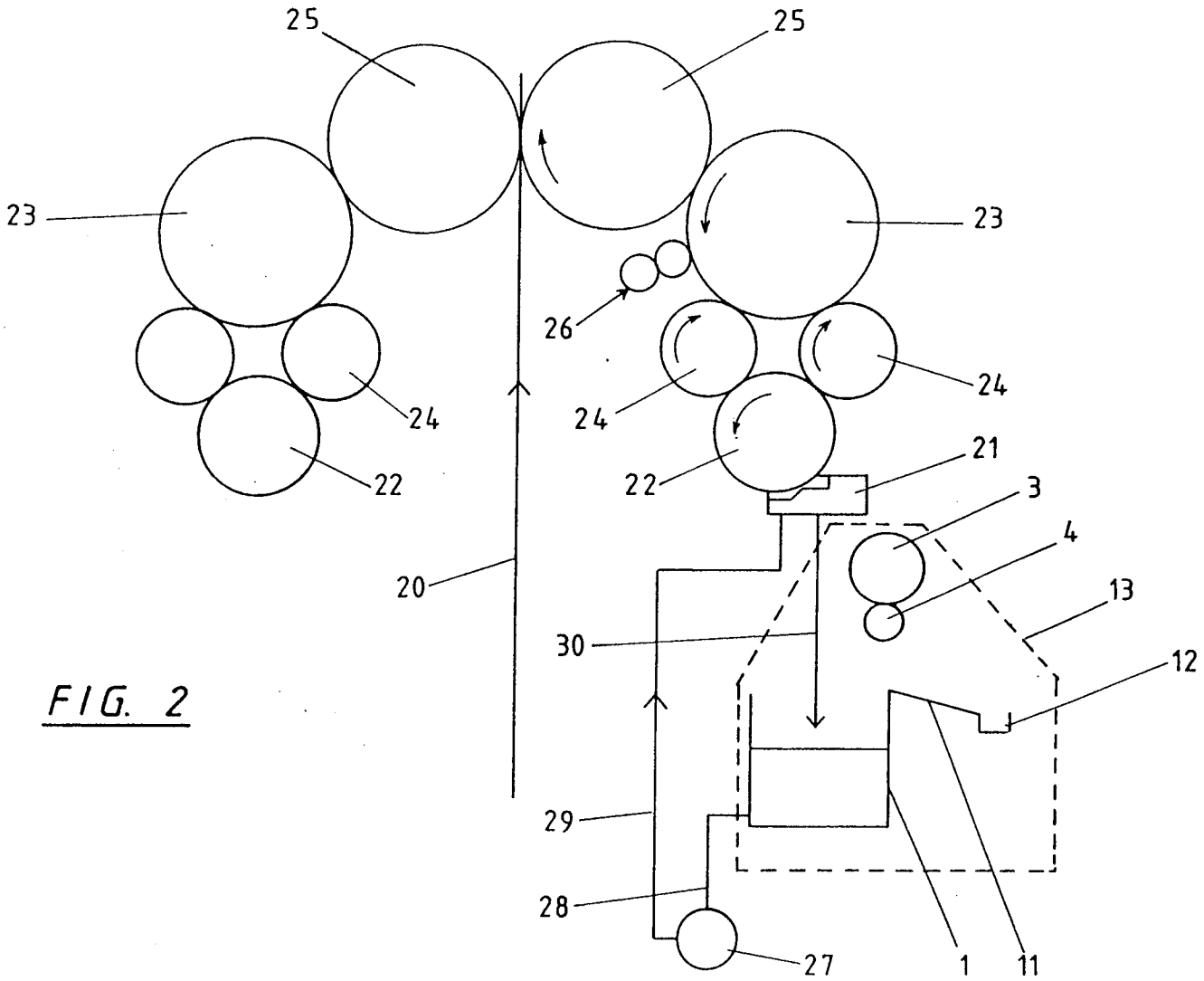
Figure 3:
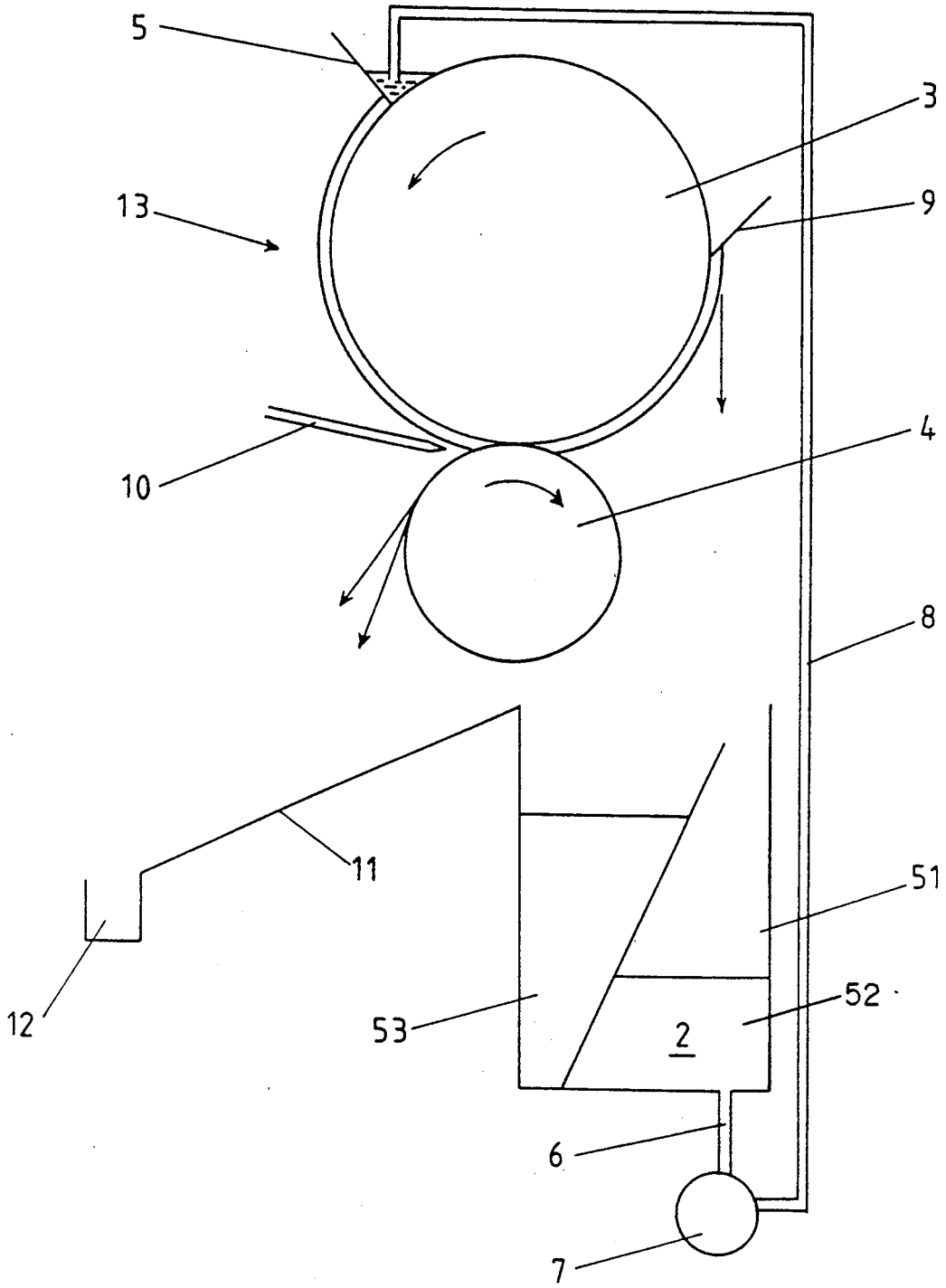

For a better understanding of the invention and to show how the same may be carried into effect, reference will now be made, by way of example, to the accompanying drawings, in which:

FIG. 1 is a schematic side view of a first ink conditioning device in accordance with the present invention, FIG. 2 is a schematic view of a printing press incorporating the device of FIG. 1, and FIG. 3 is a view corresponding to FIG. 1, of a second ink conditioning device in accordance with the present invention.

Referring now to FIG. 1, the ink conditioning device 13 is an integral part of the ink tank of the printing press. The device 13 co-operates with the tank 1 containing emulsified lithographic printing ink 2 and forming part of a closed loop inking system of a printing press. Mounted within the device is a pair of oppositely rollers 3 and 4 which cooperate together to form a nip. The roller 3 is of larger diameter and is formed of steel and smaller roller 4 is formed of rubber. The rollers 3 and 4 are urged together under pressure by a suitable means (not shown). A duct blade 5 is located so that it is normal to the surface of the roller 3 and slightly spaced therefrom. The direction of rotation of the roller 3 is denoted by the arrow. The tank 1 includes an outlet which is connected by means of a conduit 6 to a pump 7. A conduit 8 has one end connected to the pump 7 and its other end terminates in the duct defined by the blade 5 and the roller 3. A doctor blade 9 is located in contact with the surface of the roller 3 in the reverse angle position downstream of the nip between rollers 3 and 4. A plurality of nozzles (only one of which is shown and is denoted by reference numeral 10) is provided and located so as to terminate adjacent to the inwardly moving side of the nip between rollers 3 and 4. An angled drip tray 11 is positioned below the nip between rollers 3 and 4 leading to a water collector 12.

Referring now to FIG. 2, the printing press comprises first and second printing units for printing both sides of a web 20 simultaneously. The printing units are essentially identical and each comprises an ink duct 21 for applying ink to an engraved roller 22 mounted for rotation about its cylindrical axis and having a cylindrical surface provided with a plurality of cells (not shown). Ink from the engraved roller 22 is transferred to the printing plate on plate cylinder 23 by means of forme rollers 24 and is then applied to the web 20 via blanket cylinder 25. A means 26 is provided to apply aqueous fountain solution to the printing plate.

Ink is fed to the ink duct 21 from the ink tank 1 of the press by means of a further outlet in the ink tank 1 connected to a further pump 27 by means of a conduit 28 and ink is pumped up to the duct 21 from the pump 27 via conduit 29. Ink in excess of that taken up by the printing image area of the plate is then returned from the duct 21 to the tank 1 by conduit 30. Each of the printing units includes an ink applying system of this type but the system is only shown in FIG. 2 for the unit on the right hand side of the Figure.

The ink duct 21 is of the type described in our European patent specification No. 0 286 305 and thus it is a substantially closed axially extending ink duct for containing the ink under pressure and bounded by the cylindrical surface of the engraved roller 22, an axially extending doctor blade in contact with the surface of the engraved roller 22, and an axially extending sealing member. The ink supplied to the ink duct contacts the surface of the engraved roller 22 and enters the cells and is thereafter transferred to the web 20 as above described. Ink in excess of that transferred to the printing image area of the printing plate and ultimately to the web 20 becomes contaminated with aqueous fountain solution. Thus, the ink being recycled to tank 1 from the ink duct 21 is emulsified with aqueous fountain solution. The content of aqueous fountain solution present in the tank 1 could gradually increase during printing until such time as it reached an unacceptable level in spite of new ink being added to the tank to replace that consumed by the press. However, this is prevented by means of the ink conditioning device of the present invention.

More particularly, a metered supply of emulsified ink is fed from the tank 1 by means of the pump 7 and conduits 6 and 8 to the duct defined by blade 5 and the steel roller 3. The duct allows a film of the emulsion to remain on the surface of the steel roller 3 and this film is subjected to a squeezing action at the nip between the rollers 3 and 4. As a consequence of the pressure thus applied to the film, the emulsion is broken down into its constituent aqueous and ink phases at the inwardly moving side of the nip. By blowing jets of air through the nozzles 10 at the nip, the aqueous phase is displaced away from the ink phase and falls as water droplets onto the drip tray 11 from whence it flows into the collector 12 and thence to waste. Thus, ink having a reduced water content passes through the nip between the rollers 3 and 4 and this is then removed from the roller 3 by the doctor blade 9 and returned to the tank 1. In this way, the water content of the emulsified ink in tank 1 is gradually reduced until such time as a steady state is reached.

Referring now to FIG. 3, parts corresponding to parts of FIGS. 1 and 2 are denoted by like reference numerals. In this case, the device 13 is in the form of a separate unit for use in conjunction with the ink tank (not shown) of a printing press. The device 13 co-operates with a container 51 which is divided into two parts 52 and 53. Part 52 receives emulsified ink 2 from the ink tank of the press and the ink conditioned by the device 13 is received by part 53 from whence it is conveyed to the ink tank of the press. The device 13 otherwise operates in a similar manner to that described with reference to FIGS. 1 and 2.

I claim:

1. An ink conditioning device for removing excess water from an aqueous emulsion of ink during lithographic printing, which device comprises:

(i) a pair of rotatable rollers co-operating together to form a nip, (ii) a means of forming a film of the emulsion on the surface of one of the rollers, which film is subjected to pressure at the nip to break down the emulsion into an ink phase and an aqueous phase, (iii) jetting means to blow gas at the nip so as to displace the aqueous phase away from the nip, and onto a collector for the aqueous phase, and (iv) means to remove the ink phase from said one of the rollers after it has passed through the nip.

2. A device as claimed in claim 1 wherein said film forming means comprises a duct blade cooperating with a first of said pair of rotatable rollers to form a duct and means of feeding emulsified ink to the duct.

3. A device as claimed in claim 1 wherein said means of removing the ink phase is a doctor blade co-operating with a first of said pair of rotatable rollers.

4. A lithographic printing press comprising:

(i) a plate cylinder for carrying a lithographic printing plate, (ii) a means of applying aqueous fountain solution to the lithographic printing plate, (iii) an inking device for applying ink to the lithographic printing plate, (iv) a tank for ink, (v) a means of supplying ink from said tank to the inking device, (vi) a means of returning ink, emulsified with fountain solution, from said device to said tank, and (vii) an ink conditioning device to remove excess water from the emulsified ink which device comprises:

(viii) a pair of rotatable rollers cooperating together to form a nip, (ix) a means of feeding a film of the emulsified ink to the nip to subject the film to pressure and thereby break down the emulsified ink into an ink phase and an aqueous phase, (x) means of separating the aqueous phase from the ink phase at the nip, and (xi) means for returning the ink phase to the tank.

5. A press as claimed in claim 4 which includes a container having a first part to receive emulsified ink from said tank and from which said film forming means feeds said film of emulsified ink to said nip and a second part to receive said ink phase and from which said ink phase is returned to said tank.

6. An ink conditioning device for removing excess water from an aqueous emulsion of ink during lithographic printing, which device comprises:

a pair of oppositely rotatable rollers cooperating together to form a nip, a means of forming a film of the emulsion on the surface of one of the rollers, which film is subjected to pressure at the nip to break down the emulsion into an ink phase and an aqueous phase at the inwardly moving side of the nip, jetting means to blow gas at the inwardly moving side of the nip as to displace the aqueous phase away from the ink phase and onto a collector for the aqueous phase, and means to remove the ink phase from said one of the rollers after it has passed through the nip.

* * * * *